US005429232A

United States Patent [19]

Orr et al.

[11] Patent Number: 5,429,232

[45] Date of Patent: Jul. 4, 1995

[54] NESTABLE CONTAINER FOR SINKS AND METHOD

[75] Inventors: Wayne Orr, Atlanta; Gray Landress, Alpharetta; Stephanie Sievert, Atlanta, all of Ga.

[73] Assignee: Titon Industries, Inc., Atlanta, Ga.

[21] Appl. No.: 6,628

[22] Filed: Jan. 21, 1993

[51] Int. Cl.[6] ..... B65D 85/62; B65D 85/00; B65D 5/00

[52] U.S. Cl. ..... 206/320; 206/509; 206/518; 206/386; 229/117.17; 229/178

[58] Field of Search ..... 206/320, 321, 509, 518, 206/519, 515, 386, 45.14, 504; 220/757; 229/117.6, 117.17, 178, 169

[56] References Cited

U.S. PATENT DOCUMENTS

| | | | |
|---|---|---|---|
| 1,678,008 | 7/1928 | Jackson | 206/518 X |
| 1,824,927 | 9/1931 | Powell | 206/45.14 |
| 1,901,532 | 3/1933 | Powell et al. | 206/45.14 X |
| 1,903,530 | 3/1933 | Pellymounter | 206/515 X |
| 1,960,635 | 5/1934 | Kinkenon | 206/45.14 |
| 2,944,723 | 7/1960 | Marino et al. | 229/117.17 X |
| 3,163,344 | 12/1964 | Tunick | 206/509 X |
| 3,425,544 | 2/1965 | Ayer et al. | 229/117.16 X |
| 3,489,269 | 10/1966 | Rosenburg et al. | 206/45.14 |
| 3,580,475 | 5/1971 | Mobley | 206/519 X |
| 3,756,499 | 9/1973 | Giebel et al. | 229/117.17 |
| 3,871,570 | 3/1975 | Garmon | 206/509 |
| 4,039,077 | 8/1977 | Sorenson | 206/320 |
| 4,164,315 | 8/1979 | Pennanen | 229/117.16 X |
| 4,312,451 | 1/1982 | Forbes, Jr. | 206/504 X |
| 4,709,852 | 12/1987 | Stoll | 206/509 X |
| 5,007,580 | 4/1991 | Morrison et al. | 229/117.17 |
| 5,096,060 | 3/1992 | Vavra | 206/320 |

FOREIGN PATENT DOCUMENTS

| | | | |
|---|---|---|---|
| 0540201 | 4/1957 | Canada | 229/117.17 |
| 0053028 | 12/1966 | German Dem. Rep. | 206/518 |
| 0386103 | 1/1933 | United Kingdom | 229/117.17 |

*Primary Examiner*—Bryon P. Gehman
*Assistant Examiner*—Ted Kavanaugh
*Attorney, Agent, or Firm*—Kennedy & Kennedy

[57] ABSTRACT

A container for nestably holding a sink for storing, shipping and displaying. The container forms from a blank of corrugated paperboard scored for folding to provide a back, two opposing side walls, and two opposing end walls. The back includes an opening for partially receiving therethrough the bowl of the sink. A pair of supports are each foldably attached along a first score to a respective one of the end walls. A plurality of sections in the support are defined by second scores. The support folds on the scores and bears against the bottom and the end wall. The sink sits on the support. Two containers are nested together by placing one container on the other. This positions the bottom side of the bowl of one sink in the bowl of the second sink.

10 Claims, 3 Drawing Sheets

NESTABLE CONTAINER FOR SINKS AND METHOD

TECHNICAL FIELD

The present invention relates to corrugated paperboard containers. More particularly, the present invention relates to corrugated paperboard containers and methods of storing, shipping and displaying sinks.

BACKGROUND OF THE PRESENT INVENTION

Many homes and commercial bathrooms are equipped with a sink for washing. Types of sinks include pedestal sinks, drop-in or self-rimming sinks, and vanity sinks. These sinks include a bowl for holding water and a rim that defines an outer edge of the sink. The vanity sink includes a countertop that extends outwardly from the bowl to form a planar surface around the bowl. The rim or countertop at the rear of the bowl includes holes for receiving a faucet fixture for communicating water into the bowl. A back splash typically extends upwardly along the back edge of the rim. The back splash prevents water from splashing from the bowl or flowing from the countertop onto the wall from which the sink extends. An annular stem extends downwardly from the bottom of the bowl for receiving a drain pipe.

Many sinks are manufactured in molds with a mixture which hardens to a stone-like rigidity. In the terminology of the art, the material in the mixture is a cast polymer, such as cultured marble. This material provides the finished sink with a smooth, marble-like surface. The finished sink is placed in a container for shipping to distribution centers and retail outlets for sale.

The stone-like sink presents special packaging considerations for storing, shipping and displaying. The container must hold the sink, protect it from damage, and display the sink for sale. A large container may hold a sink with padding for protection, but if the container is excessively large, transportations, handling, and storage costs are increased. Reducing these costs with a smaller container and less padding, however, may lead to damage to the sinks during handling and shipping. For example, the sink made of cultured marble particularly is susceptible to chipping or cracking. Chips and cracks often are caused by sharp hits during handling and shipping. The hits may be caused by equipment handling the container, for example, a fork lift truck. Also, one container may be caused to hit another and damage to the sinks in each may occur. The container preferably protects the sink from damage caused by such hits, or at least reduces the force of the blow and thereby resists damage to the sink. Also, the outwardly-extending bowl and drain biases the sink to tipping in the container. The container preferably provides a sturdy base so that the sink does not fall over during storage and display. Finally, the sink preferably is viewable during display for sale. The consumer can inspect the sink before purchase. The container therefore preferably continues to protect the sink until it is removed for installation.

Corrugated paperboard containers have been used to hold and protect sinks for storing, shipping and displaying. Corrugated paperboard containers typically are formed from a single blank having scores that define four wall panels. A flap, known in the packaging industry as a manufacturer's joint, joins one end of the blank with the other to form a knocked-down container. Flaps foldably attach to the walls along scores to define the bottom and the top of the container when it is assembled for holding a sink. These containers are known in the industry as regular slotted containers. In the terms of the industry, the container is "squared-open" and the bottom flaps are secured together, such as with tape or staples. The sink is placed inside and the top flaps closed and secured together.

The use of padding in such regular slotted containers varies. The containers hold the sink closely to the bottom and walls of the container. The annular stem for the drain bears on the bottom and may be damaged or chipped during handling. The bottom and other contact points of the container may thereby be worn. This could weaken the container, create a hole and tears, and may lead to damage of the sink. To cushion the sink against handling shocks, egg-carton type padding is placed on the bottom of the container and on the sink before the top flaps are closed. In other containers, corrugated paperboard tubes having rectangular cross-sections support the sink in the container. For example, corrugated tubes positioned in the corners of the container restrict the sink from tipping and from contacting the walls of the container. In other of such containers, corrugated tubes are positioned on the bottom flaps against the opposing sides of the container. The sink sits in a sleeve on the tubes. The bowl of the sink inserts through a slotted opening in a sheet of corrugated paperboard that forms the sleeve. Flaps on the sides of the sheet fold inward and form tubes that sandwich around the rim of the sink. The sleeve holds the sink in the container. The bottom surface of the sleeve rests on the tubes which support the sink in the container. Another four-panel container uses a styrofoam block with a cavity that receives the sink. Styrofoam pads may also be used to cushion the sink in the container. The styrofoam however is bulky and its disposal problems lessen its utility as a packing and shipping material.

The four-panel containers discussed above are bulky and sized to form a rectangular shell around the sink. The sinks are placed square in the container, so that the countertop is horizontal and parallel to the top flaps of the container. The height of the container is sufficient to enclose the sink including the upwardly extending back splash and the downwardly extending bowl and annular stem. The space in the container accommodates the downwardly extending bowl and the upwardly extending L-shaped back splash and countertop. While the container affords protection to the sink during shipping and handling, the size of the container limits the number of containers that can be held in a typical rack storage shelf or on a pallet. A container that occupies a smaller volume would permit more containers to be displayed on a shelf or held on a pallet. This would reduce handling and shipping costs of sinks.

These known containers have other drawbacks which limit their usefulness for display of the sink. The closed container prevents the consumers at retail centers from examining the sink. To solve the display problem, a dashed line has been imprinted around an upper portion of the container. The dashed line indicates where the container could be cut so that it is easily opened for inspection and display. While facilitating inspection and display of the sink, removal of the upper portion of the container presents drawbacks. The opened carton could not be placed on its side, for example, on shelves. The sink would tip out. Sales centers accordingly have to stack the containers of sinks. Also, consumers resist for any number of reasons purchasing an item in an open container. The reasons for resistance include the perception that parts may be missing, the perception that the sink may be damaged, and a perception that another consumer purchased and then returned the item for unknown reasons. Labor and time is also required to place and open the containers.

Accordingly, there is a need in the industry for an corrugated paperboard container for that more efficiently uses storage space for holding sinks, protects and cushions the sink during handling and shipping, and displays the sink for sale without modification.

SUMMARY OF THE INVENTION

The present invention solves the problems of a container for storing, shipping and displaying sinks. The container of the present invention holds a sink while compactly nesting the container with another container to reduce the space required for storing sinks, cushions and protects the sink during handling and shipping, and displays the sink for sale without modifying the container.

Generally described, the container of the present invention forms from a blank of corrugated paperboard scored for folding to provide a back, two opposing side walls, and two opposing end walls. A pair of supports are each foldably attached along a first score to a respective one of the end walls. A plurality of sections in the supports are defined by second scores. Each of the supports is folded on the scores and bears against the bottom and the end wall. The sink sits on the supports which cushion the sink during handling and shipping.

More particularly described, the supports are disposed at an acute angle to the back. This positions the sink angularly within the container.

In another aspect of the present invention, the end wall includes a tab that foldably extends from the end wall. The tab defines a hand-grip opening in the end wall. One section of the support has a key opening. The key opening receives the tab to secure the folded support against the end wall.

More particularly described, the back of the container includes an opening. The bowl of the sink is partially received through the opening. In one aspect of the invention, the opening is defined by a plurality of slits that cross through an apex. The slits form a plurality of webs of corrugated paperboard that cover the bottom surface bowl in the opening.

More particularly described, the present invention provides a corrugated paperboard container for holding a sink having a bowl extending from an upper rim. The container is particularly suited for stacking, in that the bowl of the sink extends through an opening in the back of the container. The bowl of the sink in one container enters the cavity defined by the sink in an adjacent container. A plurality of containers having sinks may be stacked to nest the sinks together. Such nesting reduces the volume required to hold a given number of sinks and containers. Increasing the number of sinks that can be grouped on a pallet reduces the transportation and handling costs for sinks.

The present invention further provides a method of grouping a plurality of sinks in containers. Generally described, the method nests the bowl and annular stem of one sink in the cavity defined by the upper surface of a bowl of a second sink in a second adjacent container.

More particularly described, the method of the present invention groups a plurality of sinks each having a bowl extending from an upper rim. Each of the sinks is placed in a container having a back, two opposing side walls, and two opposing end walls. The container is formed by folding a blank of corrugated paperboard on scores. The bowl partially extends through an opening in the back. The sink sits on a pair of supports that foldably attach to respective end walls at an angle with the back. One container is placed on another whereby the bowl, being partially extended through the opening in the one container, is nestably received in the cavity defined by the bowl of the sink in the second container.

More particularly described, the method of the present invention further comprises an intermediate step of folding a front plate attached to the side panel perpendicular to cover the rim and retain the sink in the container. A pair of tabs are attached to the side panel and are separable from the front plate. When the front plate is folded perpendicular, the pair of tabs extend upwardly. The tabs align the placement of another container thereon.

More particularly described, the method of the present invention includes an intermediate step of folding a support attached to the end wall on a score. The support bears against the back and the end wall for holding a sink.

More particularly described, the method of the present invention includes locking the support to the end wall. A tab extends from the end wall. The tab inserts through an opening in the support to lock the support to the end wall.

Accordingly, it is an object of the present invention to improve the holding of a sink in a corrugated paperboard container.

It is another object of the, present invention to improve the protection from damage for a sink held in a corrugated paperboard container.

It is another object of the present invention to reduce the space required for shipping and storing containers of sinks.

It is another object of the present invention to display a sink for viewing by a consumer at a retail sales facility.

It is another object of the present invention to display a sink without modifying the container in which the sink is shipped and stored.

It is another object of the present invention to align containers of sinks held in a stack.

It is another object of the present invention to nest containers of sinks together for display at a sales center.

Still other objects, features and advantages will become apparent upon a reading of the following detailed description in conjunction with the drawings and the appended claims.

DETAILED DESCRIPTION OF THE PREFERRED EMBODIMENT

Figure 1:
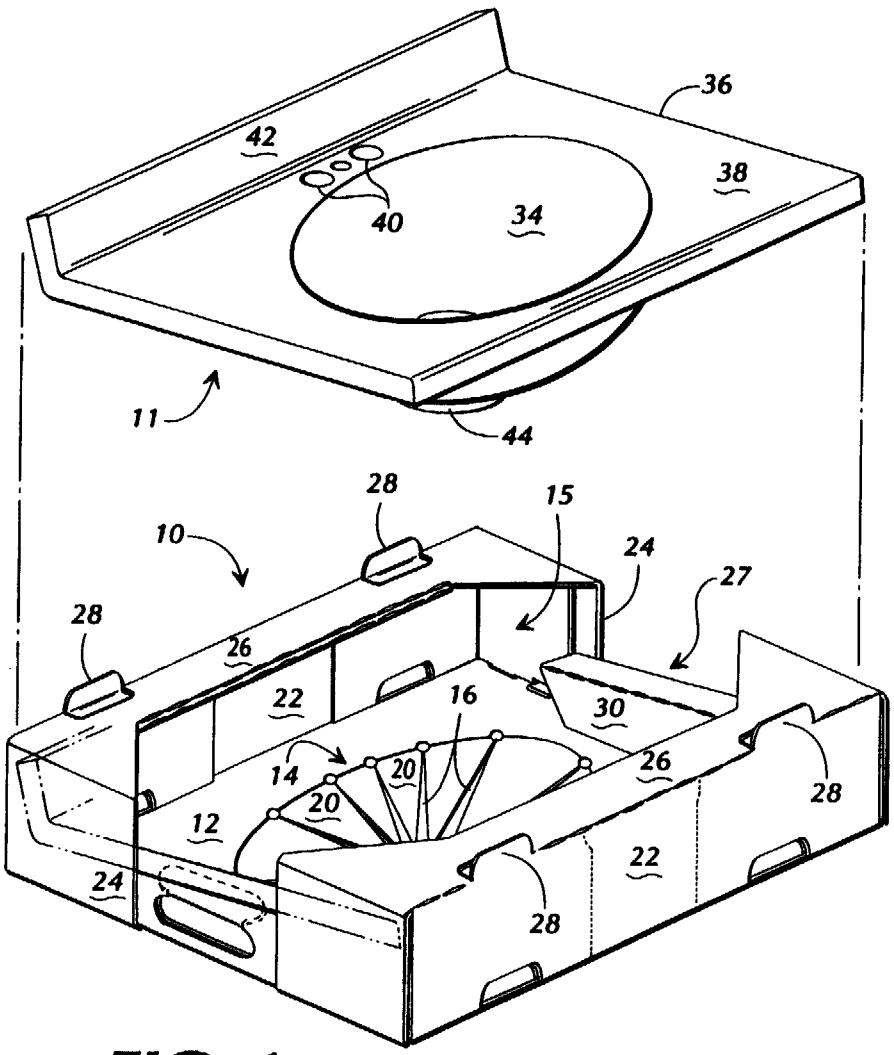
FIG. 1 is perspective cut-away view of a preferred embodiment of a corrugated paperboard container of the present invention, with a vanity sink exploded therefrom and a side edge of a vanity sink shown in the container in phantom.

Referring now in more detail to, the drawings, in which like numerals indicate like parts throughout the several views, FIG. 1 illustrates a perspective, partially cut-away view of a container 10 constructed in accordance with the present invention for holding a vanity sink 11. Although the illustrated embodiment of the present invention is for a vanity sink, other styles of sinks such as pedestal sinks and self-rimming sinks can be stored, shipped and displayed in containers of the present invention. The container 10 includes a back 12 having a webbed cutout 14 and corners 15 formed by folding flaps together, as discussed below. A plurality of slits 16 cross at an apex 18 (best illustrated in FIG. 2) to define a plurality of webs 20, for a purpose discussed below. The container 10 includes two opposing side panels 22 and two opposing end panels 24. These panels foldably attach along scores to the back 12 as discussed below. A face plate 26 foldably attaches to each side panel 22 for retaining the vanity sink 11 in the container 10. The face plates 26 and edge of the end panels 24 cooperate to define a viewing window 27. A pair of spaced-apart tabs 28 attach to the side panel 22. Slits separate the three sides of each tab 28 from the face plate 26. The tabs 28 extend upwardly from the side panels 22 and guide the placement of another container onto the container 10, as discussed below for stacking the containers and nesting the vanity sinks together. A support 30 foldably attaches to each end panel 24. The support 30 folds on scores to form a floating handle that bears against the back 14 and the end panel 24, as discussed below. The vanity sink 11 rests on the supports 30 which cushions the vanity sink from rough handling of the container 10 during shipping and storing. FIG. 1 illustrates in phantom a side edge, of the vanity sink 11 in the container 10. As illustrated, the supports 30 preferably form an acute angle to the back 14 as discussed below. The container 10 and the Vanity sink 11 contained therein define an open cavity generally designated 27 for nestably receiving the bowl of a second container, as discussed below.

The vanity sink 11 includes a bowl 34 for holding water and a rim 36 that defines an outer edge of the vanity sink. A countertop 38 extends outwardly from the bowl 34 to form a planar surface around the bowl. The countertop 38 at the rear of the bowl 34 includes a plurality of holes 40 for receiving a faucet fixture (not shown) for communicating water into the bowl. A back splash 42 extends upwardly along the back edge of the rim. The back splash 42 prevents water from splashing from the bowl 34 or flowing from the countertop 38 onto the wall from which the vanity sink 11 extends. An annular stem 44 extends downwardly from the bottom of the bowl 34 for receiving a drain pipe (not shown).

Figure 2:
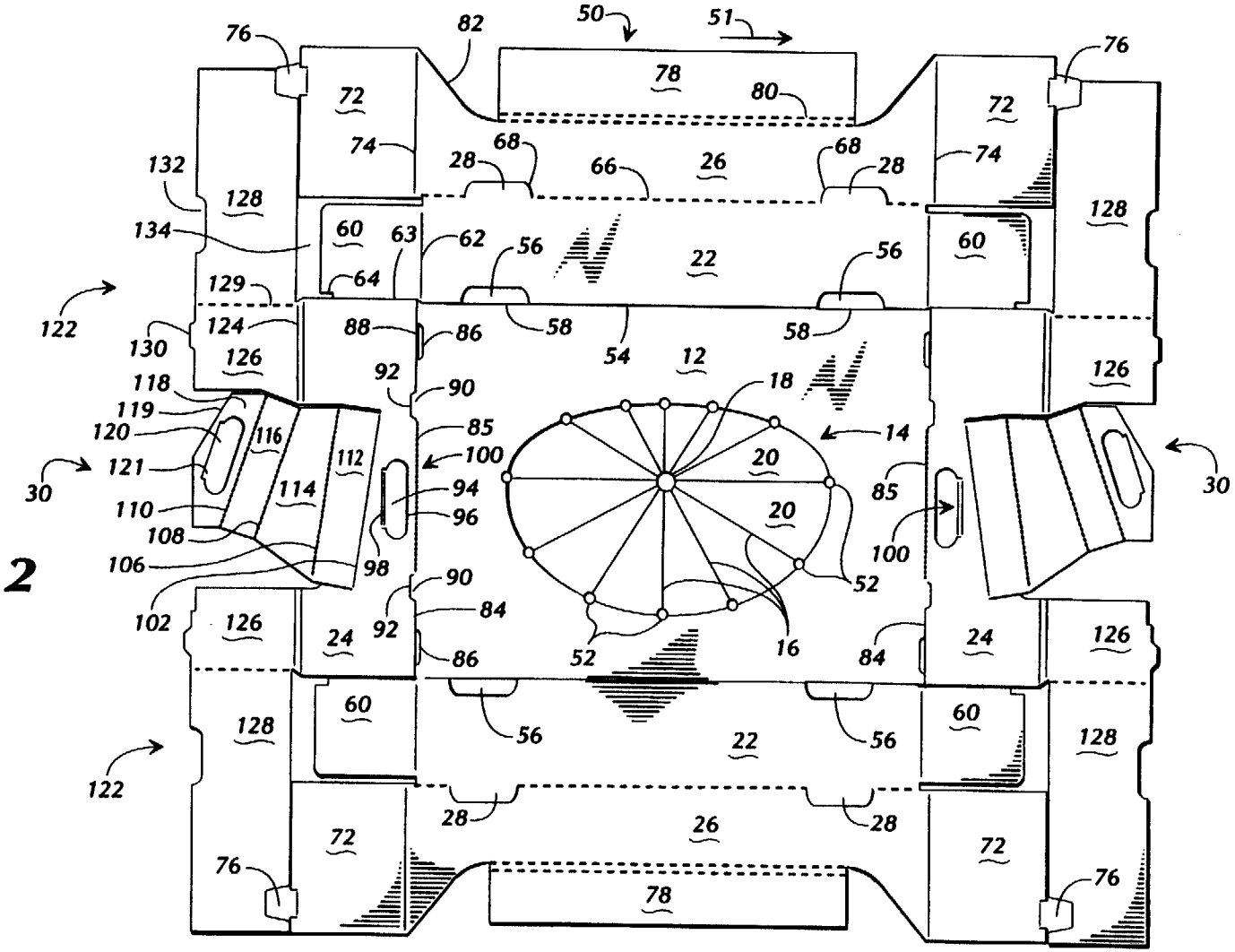
FIG. 2 is a top plan view of a corrugated paperboard blank for forming the container shown in FIG. 1.

With reference to FIG. 2, the container 10 forms from a blank 50 of corrugated paperboard material having a direction of corrugation shown by the arrow 51. The blank 50 includes a plurality of scores and slits that define panels, tabs and cut-outs for foldably forming the container 10. The blank 50 includes the back 12, the two opposing side panels 22, and the two opposing end panels 24. The back 12 includes the webbed cutout 14. The webbed cutout 14 generally conforms to the shape of the bowl underneath the countertop of the vanity sink 11. The cutout 14 receives the bowl 34 of the vanity sink 11 held in the container 10. The webbed cutout 14 is formed by the plurality of slits 16 that join to the apex 18. The slits 16 are formed by straight blades in a die that is forced in the blank during manufacturing. The use of dies to cut, blanks of corrugated paperboard is well known in the industry. Each slit 16 terminates at a circular cutout 52 and the apex 18 formed by punches in the die. The cutouts 52 reduce outward tearing of the back 12 when the bowl 34 is inserted through the cutout 14.

The bowl 34 partially extends through the cutout 14. The slits 16 define the plurality of paperboard webs 20 that cover the bottom surface of the bowl 34 of the vanity sink 11 in the container 10. When the containers 10 are nested together, the webs 20 further help protect the smooth surface of the bowl from chipping. In an alternate embodiment, the webs 20 are removed, so the back 12 includes an opening through which a portion of the bowl extends when the container 10 receives the vanity sink 11.

The side panels 22 foldably join along a respective score line 54 to the back 12. A pair of spaced-apart cutouts 56 are defined in a lower portion of each of the sides 22. Each cutout 56 has an edge 58 offset from the respective score 54. The offset is approximately equal to the thickness of the corrugated paperboard blank 50. The cutout 56 receives one of the tabs 28 from another container when stacking the containers. The offset facilitates entry of the tab 28 into the cutout 56.

An inside flap 60 foldably connects along a score 62 at each longitudinal end of the two opposing side panels 22. The inside flap 60 has an edge 63, discussed below. An inside corner edge of the inside flap 26 includes a notch 64, for a purpose discussed below. Each of the inside flaps 60 cooperates with other parts discussed below to form one of the corners 15 of the container 10. The face plate 26 foldably connects along a perforated score 66 to an outside edge of each side panel 22. The score 66 is perforated to facilitate folding with the corrugations and to allow the face plate to back bend for packing the vanity sink. The pair of spaced apart tabs 28 are cut in each of the face plates 30. The tabs 28 transversely align with the cutouts 56. Each tab 28 is defined by a cut 68 made on three sides in the face plates 30. The fourth side is common with the perforated score 66. The tab 28 separates on the cut 68 from the face plate 26 for a purpose discussed below. An outside closing flap 72 foldably connects along a score 74 to a longitudinal end of each face plate 26. A tab 76 foldably connects to an outside edge of each outside closing flap 72. The outside closing flaps 72 lock the container 10 in the assembled form, as discussed below.

In the illustrated embodiment, an inside face plate 78 foldably attaches along a double perforated score 80 to an outside edge of the face plate 26. The double perforated score is a pair of closely-spaced, parallel perforated scores. The double perforated score 80 facilitates folding the inside face plate 78 against the face plate 26, as discussed below. The inside face plate 78 is centered between the longitudinal ends of the face plate 26. An outside edge 82 of the face plate 26 tapers inwardly from the score 74 to the perforated score 80. When the container 10 is foldingly assembled, the tapering edges 82 of the face plates 30 and the edges of the end panels 24 define the viewing window 27 for a consumer to see the vanity sink 11 in the container as best shown in FIG. 1.

Each of the end panels 24 foldably attaches to the back 12 along a respective score 84. A medial portion 85 of the score 84 is perforated to facilitate folding the end panels 24 as discussed below. A pair of spaced-apart slots 86 are cut in the back 12 and each one is positioned inwardly of one of the respective scores 54. Each slot 86 shares an edge 88 common with the score 84. A tab 90 is defined inwardly of each slot 86 in the end panel 24 by a cut 92. The tab 90 is positioned with one side on a line common with the score 84, for a purpose discussed below. A tab 94 is defined by a cut 96 and a score 98 in each end panel 24. The tab 94 and opening formed thereby define a hand grip 100 in the end panel 24. The perforations in the score 85 assists folding the end panels 24 on the scores 84 and 85 so that the end panels da not crease through the hand grips 100.

The supports 30 foldably attach to the end panels 24. The supports 30 receive and support the vanity sink in the container 10. One of the supports 30 foldably connects along a score 102 to each of the end panels 24. At least two second scores define sections in the support 30. The side supports 30 in the illustrated embodiment include three second scores 106, 108, and 110 which define four sections in the supports: an upper surface 112, a side wall 114, a bottom wall 116 and a second side wall 118. The second side wall 188 includes an angled outside edge 119. The score 106 is parallel to the score 102. The scores 108 and 110 are parallel. The support 30 folds on the scores 102, 106, 108, and 110 to form a four-sided tube. The side wall 114 the and bottom wall 116 bear against the back 12. The second side wall 118 bears against the end panel 24. The rim of the vanity sink 11 rests on the upper surface 112 of the support 30. The outermost section 118 of the support 30 includes a key opening 120 which has a notch 121. When the support 30 is folded on the scores 102, 106, 108, and 110, the tab 94 engages the key opening 120 to lock the support as a folded tube against the end wall 24.

A pair of inside plates 122 foldably attach along a double score 124 to the outside edge of each end panel 24. One of the inside plates 122 attaches at each longitudinal end of the end panels 24. The inside plate 122 comprises an inside end plate 126 and an inside side plate 128. The inside side plate 128 foldably connects along a perforated score 129 to an edge of the inside end plate 126. The inside plate 122 cooperates with the inside flap 60 to form a respective one of the corners 15 of the container 10.

A tab 130 extends outwardly from an outside edge of the inside end plate 126. The tab 130 enters the slot 86 when the blank 50 is formed into the container 10. This holds the inside plates 122 and the inside flap 60 together as a corner 15 of the container 10. The inside side plate 128 includes a notch 132 which conforms in shape to the cutout 56 in the side panel 22. A cutout 134 defines an L-shaped opening in the corrugated paperboard blank 50 between the inside side plate 128, the inside flap 60, and the outside closing flap 72. The paperboard in the cutout 134 is discarded as scrap material.

With continued reference to FIGS. 1 and 2, the container 10 forms by folding the blank 50 along the respective scores to form the side and end panels of the container 10. First, the side panels 22 fold along the scores 54 perpendicular to the back 12. The inside flaps 60 are then each folded on the respective score 62 perpendicular to the side panel 24 with the edge 63 against the inside surface of the back 12. The notch 64 provides an opening so that the inside flap 60 does not cover the respective slot 86. The end panels 24 fold along the scores 84 and 85 perpendicular to the back 12. This brings the inside surface of the end panel 24 against the respective inside flaps 60. The inside side plate 128 reverse folds in a first outward direction along the perforated score 129. The inside end plate 126 then folds along the double score 124 over the inside flap 60. This brings the inside side plate 128 against the inside surface of the side panel 22. The tab 130 engages the slot 86 to lock the inside plates 122 in position and thereby form one of the rigid corners 15 of the container 10. The notch 132 aligns with the cutout 56. The other inside plates 122 are then folded as discussed above to form the transverse opposite corners of the container 10.

Next, each of the side supports 30 forms into a tube by folding inwardly along the scores 102, 106, 108, and 110. The tab 94 pushes through the opening 120 and grippingly engages the notch 121 in the key opening. This locks the side support 30 as a tube against the end panel 24. The side wall 114 and the bottom wall 116 of the support 30 rest against the inside surface of the back 12 and the end panel 24. The second side wall 118 rests against the end panel 24. The tube support 30 floatingly receives and cushions the vanity sink 11 in the container 10.

The container 10 is then ready to receive a vanity sink 11. The vanity sink 11 inserts with the bowl 34 and the annular stem 44 extending through the webbed cutout 14 in the back 12. The opening in the back 12 is smaller than the bowl 34 so that the bowl extends partially through the webbed cutout 90. This provides a gap between the bottom of the bowl 34 in one container and the upper surface of the bowl in the other container, when the containers are nested together. The underside of the rim of the vanity sink 11 rests on the upper surface of the supports 30. The supports 30 are formed at an acute angle to the back 12. The supports 30 thereby hold the vanity sink 11 at an angle in the container 10. The angle is selected so that the upper edge of the back splash 42 is in the same horizontal plane as the front edge of the countertop 38, as illustrated in phantom in FIG. 1. The back splash 42 of the vanity sink 11 is thereby disposed in the container 10 at an angle to the side panel 22, providing the container with a low-height profile. The vanity sink 11 is preferably held by the supports 30 and the cutout 14 above the back 14 such that a gap of about 1 inch is provided between the vanity sink and the back.

Figure 4:
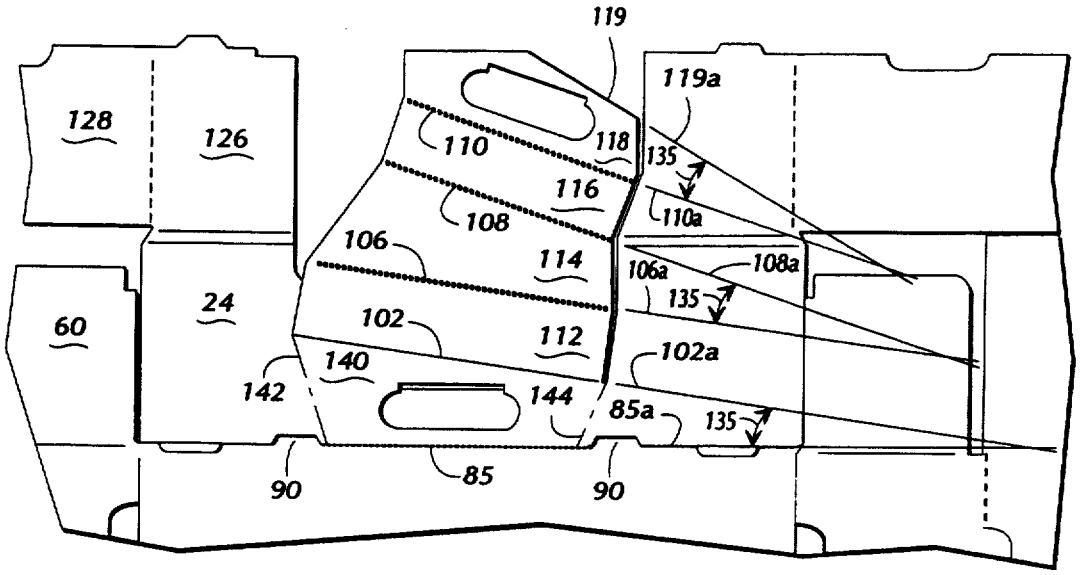
FIG. 4 is an enlarged cut-away plan view showing in detail the support portion of the paperboard blank illustrated in FIG. 2.

FIG. 4 is an enlarged plan view of the portion of the blank 50 to illustrate details of the support 30. The relationships of the scores 102, 106, 108, and 110 and the outside edge 119 are defined by the angle at which the support 30 is oriented. Lines **85*a*, 102*a*, 106*a*, 108*a*, 110*a*, and 119*a* are shown as extending the scores 85 and 102, 106 and 108, and 110 and the edge 119 to common respective intersections. Scores 85 and 102 thereby define an acute angle 135. Similarly, scores 106 and 108 define the acute angle 135 as do the score 110 and the outside edge 119. The side walls 114 and 118 are mirror images of a portion 140 of the end panel 24. The portion 140 is defined by the scores 102 and 85, a leading edge 142 (shown in phantom) and a trailing edge 144 (shown in phantom). The leading edge 142 angles back so that the side walls 114 and 118 do not block the cut that forms the respective tab 90. The trailing edge 144 angles forward so that the side walls 114 and 118 do not block the cut that forms the respective tab 90. As discussed below, the tab 76 inserts into the cut to lock the assembled container 10** together.

The vanity sink 11 is locked in place by folding the face plates 26 along the respective scores 66. In the illustrated embodiment, the inside face plate 78 first folds against the inside surface of the face plate 26. The inside face plate 78 provides additional padding and protection for the upper surfaces of the vanity sink 11. The outside closing flaps 72 then fold along the scores 74. The tab 76 inserts into the cut that forms the tab 90 to lock the face plate 26 in position and secure the container 10.

Figure 3:
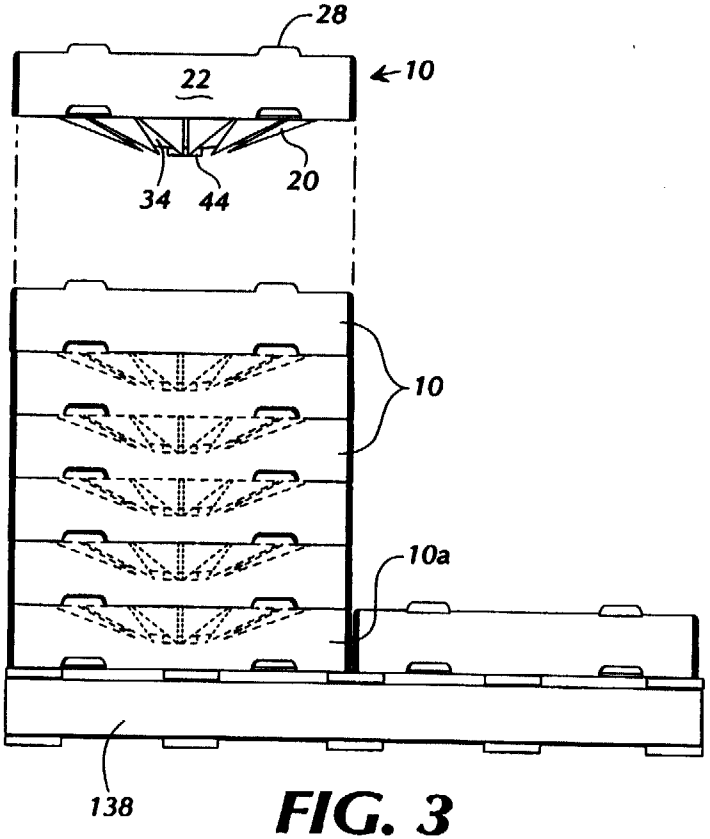
FIG. 3 is a side view of a pallet having a stack of the containers shown in FIG. 1.

The tabs 28 separate from the face plate 26, as best illustrated in FIG. 3 and extend upwardly from the side panel 22. The tabs 28 facilitate stacking a plurality of containers 10 together, such as for shipment on a pallet 138 as illustrated. The vanity sink 11 extends through the webbed opening 94 as shown in cutaway view in FIG. 3. The bottom surface of the bowl and the annular stem of the vanity sink 11 extend into the cavity 32 defined by the open bowl of the vanity sink held in an adjacent container 10*a*. To avoid interference by the blades of a fork lift truck of the sink, the bottom containers 10*a* on the pallet are marked and shipped empty.

As discussed above, there is gap between the two nested bowls. The webs 20 cover the bottom surface of the one bowl and thereby restrict the bowl from scratching, or damaging the inner surface of the adjacent bowl, in the event the back 12 collapsed during handling of the container 10. The container 10 of the present invention accordingly facilitates stacking of vanity sinks by nesting vanity sinks together. The tabs 28 align the placement of one container on another in the stack and resist rotational movement of the containers during handling and shipping. The containers 10 of the present invention nest the vanity sinks together, which enables a greater number of vanity sinks and containers to be held in a given amount of space.

A strap (not illustrated) attaches to the pallet 138 and extends over the stack of containers 10 to secure the stack to the pallet. The entire pallet 138 may then be covered with stretch plastic to enclose the stack of containers on the pallet. The plastic protects the vanity sinks from dust. The pallet is easily handled by fork-lift trucks and the like for storage and subsequent shipping of the vanity sinks to sales centers.

Warehouse-style sales center typically use steel-frame racks to hold products. The pallets of containers 10 are easily moved by fork-lift truck onto the racks. The plastic sheet is removed and the containers of vanity sinks are ready for display. Typically, the containers 10 are stacked with the back 12 horizontal as a bottom for the container. Consumers may see the vanity sink in viewing window 27 and select the vanity sink from stack.

Figure 5:
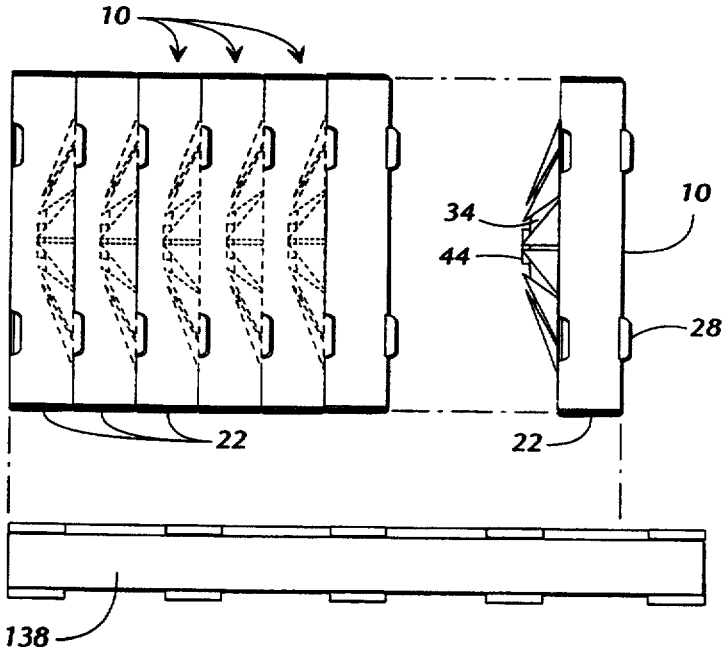
FIG. 5 is a side view of containers of the invention shown in FIG. 1 standing side-by-side on respective side panels and exploded away from a pallet support.

The container 10 may also be placed on the racks with one side panel 22 horizontal and the back 12 vertical as shown in FIG 5. The partial passage of the bowl through the opening 14 in the back 12 and disposing the vanity sink 11 angularly in the containers enables the vanity sink to balance on the front edge of the rim. The side panel 22 provides a stable base on which the container 10 may stand. Different styles of vanity sinks may thereby be lined up on an eye-level shelf of the rack for viewing by consumers, with a stack of the vanity sinks held in the containers on pallets below the shelf.

The nesting feature of the container 10 of the present invention permits more containers per space. This reduces the handling of containers and the labor associated with restacking of goods. For example, a container 10 of the present invention sized for a 17×19 inch vanity sink permits about a 2 to 1 increase in the number of vanity sinks that can be held on a typical 4×4 foot pallet. Instead of approximately 20 vanity sinks comprising a pallet load, the container 10 permits approximately 40 vanity sinks to be held.

The principles, preferred embodiments, and modes of operation of the present invention have been described in the foregoing specification. The invention is not to be construed as limited to the particular forms disclosed because these are regarded as illustrative, rather than restrictive. Moreover, variations and changes may be made by those skilled in the art without departing from the spirit of the invention as described by the following claims.

What is claimed is:

1. A corrugated paperboard container for holding a sink having a bowl extending outwardly from a rim, comprising:

a blank of corrugated paperboard scored for folding to define a back with an opening for receiving therethrough a lower portion of a bowl of a sink, the blank further including side panels foldably attached around the periphery of the back and extending laterally at a perpendicular angle from the back, one of said side panels forming a base whereby the container stands on the one side panel, the laterally extending side panels and bottom defining a cavity for receiving the sink, and means for disposing the sink such that a plane defined by an upper surface of the sink is at an acute angle with respect to the back of the container, whereby a pair of the containers, being placed together side-by-side, nests the lower portion of the bowl of the sink in one of the containers within the cavity of the second container.

2. The corrugated paperboard container as recited in claim 1, wherein means for disposing comprises a pair of supports, each foldably attached to opposing side panels and having a plurality of sections defined by scores, whereby each of the supports, being folded on the scores, contacts the back and the respective side panel to support the sink.

3. A corrugated paperboard container for holding a sink having a bowl extending from an upper rim, comprising:

a blank of corrugated paperboard scored for folding to provide a back, two opposing side walls, and two opposing end walls, the back includes an opening for receiving the bowl partially therethrough, and each of the end walls includes a tab that foldably extends therefrom;

a pair of supports, each foldably attached along a first score to a respective one of the end walls and having a plurality of sections defined by second scores, and one of the sections includes a key opening, whereby the supports, being folded on the scores, bears against the back and the respective end wall for supporting a sink thereon and a respective one of the tabs, being inserted in the key opening, locks the support to the end wall.

4. The corrugated paperboard container as recited in claim 3, wherein the opening is defined by a plurality of slits crossing at an apex to form a web of corrugated paperboard for covering the bowl in the opening.

5. The corrugated paperboard container as recited in claim 3, further comprising:

an inside end plate foldably attached along a portion of an outside edge of each end panel at each longitudinal end; and an inside side plate foldably attached to a side edge of each of the inside plates, whereby a corner of the container is formed by folding the respective inside side plate in a first direction against an inside surface of the side wall and by folding the adjacent inside end plate in a second opposite direction against an inside surface of the end wall.

6. The corrugated paperboard container as recited in claim 5, wherein the inside end plate includes a tab extending outwardly from an outside edge; and wherein the back includes a slot adjacent the end wall for receiving the tab when the corner is formed.

7. The corrugated paperboard container as recited in claim 3, further comprising:

a front plate foldably attached to the side panel; and a pair of spaced-apart tabs attached to the side panel and separable from the front plate, whereby the front plate, being folded perpendicular to the side panel, covers and retains the sink in the container with the tabs extending upwardly for aligning a second container placed on the container.

8. A corrugated paperboard container for holding a sink having a bowl extending from an upper rim, comprising:

a blank of corrugated paperboard scored for folding to provide a back, two opposing side Walls, and two opposing end walls, the back includes an opening defined by a plurality of slits crossing at an apex to form a web of corrugated paperboard for covering the bowl received partially therethrough, and each of the end walls includes a tab that foldably extends therefrom;

a pair of supports, each foldably attached along a first score to a respective one of the end walls and having a plurality of sections defined by second scores, and one of the sections includes a key opening;

a front plate foldably attached to the side panel; and a pair of spaced-apart tabs attached to the side panel and separable from the front plate, whereby the front plate, being folded perpendicular to the side panel, covers and retains the sink in the container with the tabs extending upwardly for aligning a second container on the container, the supports, being folded on the second scores, bear against the back and the respective end wall for supporting the sink thereon and a respective one of the tabs, being inserted in the key opening, locks the support to the end wall.

9. The corrugated paperboard container as recited in claim 8, further comprising:

an inside end plate foldably attached along a portion of an outside edge of each end panel at each longitudinal end; and an inside side plate foldably attached to a side edge of each of the inside plates, whereby a corner of the container is formed by folding the respective inside side plate in a first direction against an inside surface of the side wall and by folding the adjacent inside end plate in a second opposite direction against an inside surface of the end wall.

10. The corrugated paperboard container as recited in claim 9, wherein the inside end plate includes a tab extending outwardly from an outside edge; and wherein the back includes a slot adjacent the end wall for receiving the tab when the corner is formed.

* * * * *